US006170304B1

(12) United States Patent
Ohta

(10) Patent No.: US 6,170,304 B1
(45) Date of Patent: Jan. 9, 2001

(54) METHOD AND APPARATUS FOR SECURING ELECTRONIC COMPONENTS

(75) Inventor: Seiya Ohta, Rocklin, CA (US)

(73) Assignee: Hewlett-Packard Company, Palo Alto, CA (US)

( * ) Notice: Under 35 U.S.C. 154(b), the term of this patent shall be extended for 0 days.

(21) Appl. No.: 09/258,775

(22) Filed: Feb. 26, 1999

(51) Int. Cl.[7] ..... E05B 73/00
(52) U.S. Cl. ..... 70/14; 70/58; 70/455
(58) Field of Search ..... 70/14, 18, 30, 70/49, 57, 58, 232, 455; 248/551–553; 292/251.5

(56) References Cited

U.S. PATENT DOCUMENTS

| | | | | |
|---|---|---|---|---|
| 2,438,231 | * | 3/1948 | Schultz et al. | 292/251.5 |
| 3,408,771 | * | 11/1968 | Garrett et al. | 292/251.5 X |
| 3,421,350 | * | 1/1969 | Shanok et al. | 70/455 |
| 3,434,318 | * | 3/1969 | Thiry | 70/455 |
| 3,782,149 | * | 1/1974 | Carter | 70/455 |
| 4,058,335 | * | 11/1997 | Abe | 292/251.5 |
| 4,825,673 | * | 5/1989 | Drake | 70/455 |
| 4,858,454 | * | 8/1989 | McAnulty, III | 70/455 |
| 5,050,836 | * | 9/1991 | Makous | 70/58 X |
| 5,099,663 | * | 3/1992 | Dearstine | 70/78 X |
| 5,327,752 | * | 7/1994 | Myers et al. | 70/58 |
| 5,381,685 | * | 1/1995 | Carl et al. | 70/14 X |
| 5,502,989 | * | 4/1996 | Murray, Jr. et al. | 70/57 X |
| 5,548,981 | * | 8/1996 | Kirk | 70/58 |
| 5,622,064 | * | 4/1997 | Gluskoter et al. | 70/58 X |
| 5,623,842 | * | 4/1997 | Davidge | 70/58 X |
| 5,709,110 | * | 1/1998 | Greenfield et al. | 70/58 |
| 5,787,737 | * | 8/1998 | Cho | 70/58 |
| 5,839,303 | * | 11/1998 | Umberg et al. | 70/58 |
| 5,884,508 | * | 3/1999 | Dwight | 70/58 X |
| 5,913,907 | * | 6/1999 | Lee | 70/57 X |
| 5,987,937 | * | 11/1999 | Lee | 70/14 |
| 6,047,572 | * | 4/2000 | Bliven et al. | 70/58 |

* cited by examiner

*Primary Examiner*—Suzanne Dino Barrett
(74) *Attorney, Agent, or Firm*—Cynthia S. Mitchell

(57) ABSTRACT

A lock that may be inserted into a standardized locking aperture, such as a standard Kensington key lock slot in the cover of a computer or other electronic device to secure the cover to the chassis of the computer or device in order to prevent unauthorized access to the internal components of the computer or electronic device. The lock may be easily installed by the end user rather than having the locking mechanism installed during the manufacture of the computer with the additional cost of a locking mechanism added to all computers. Further, the locking mechanism may be removably attached to the outer cover of the computer or electronic device by means of an adhesive, double sided tape, Velcro, a hook or magnet, so that the locking mechanism may be removed and reused with a different computer or electronic device as the device is replaced, upgraded, etc. or as security needs change.

18 Claims, 7 Drawing Sheets

METHOD AND APPARATUS FOR SECURING ELECTRONIC COMPONENTS

FIELD OF THE INVENTION

The present invention relates generally to the field of computers and more particularly to a method locking a computer chassis. In particular, this invention provides a removable and reusable security system for computers and other electronic components.

BACKGROUND OF THE INVENTION

As the use of personal computers and other business and personal electronic devices proliferates, and as the population becomes more and more computer literate, the necessity of computer security becomes more and more significant. Personal and business computers are often situated in physical locations where access to the computer cannot be completely controlled. In the past, sensitive information was typically stored in a filing cabinet which could be locked when the custodian was absent. When computers initially became prevalent, they were large machines housed in separate rooms and accessible only to those with specialized knowledge, making security more or less inherent in the cumbersome nature of the large computer systems.

Now, however, sensitive information is typically resident in the hard disk of a desktop computer, such computers can be accessed by many people with knowledge of standard computer software, and the security of such information is more difficult to maintain. Many of today's high tech products have removable components that are valuable in terms of material cost and/or the data that is contain therein. To reduce the risk of theft of these valuable components such as microprocessors, memories, modems, hard discs, data cartridges, and so on, there are products on the market to lock the covers of computer or electronic devices and the chassis or to secure the device to a secure or permanent object, such as a large desk. The most common solution is a tumbler keylock that is permanently attached to a cover of a device.

However, the degree of security required for a particular computer or electronic device depends upon the environment that the computer is placed in and the permanent keylock solution is an unnecessary expense for those who do not require a secured computer. Also, for a manufacturer to customize the built-in tumbler keylock based on each customer's requirements is a costly and complicated task. The alternative to the keylock is a paddle lock which requires a product to have a specially designed tabs to attach the lock. However, it is also not desirable to have tabs protruding from the product when one has no use for a secured computer.

One of the more popular solutions on the market today is a Kensington Micro Saver Security System, as disclosed in U.S. Pat. No. 5,327,752, which is incorporated herein for all that it teaches and discloses. The Kensington Micro Saver Security System is primarily designed to secure portable computers to a secured object only requiring a computer to have a small slot where an end of the locking mechanism extends into and locks the computer upon turning a key. However, this locking mechanism is designed with an attached cable to secure the computer to a larger, more stationary object, and when it is unlocked, it is no longer attached to the computer, similar to a paddle lock.

Accordingly, it would be desirable to have a lock that may be inserted into a standardized locking aperture in the cover of a computer or other electronic device to secure the cover to the chassis of the computer or device to prevent unauthorized access to the internal components of the computer or electronic device. It would further be desirable for the lock to be easily installed by the end user as the end user finds the need for additional security, rather than having the locking mechanism routinely installed by the factory with the additional cost added to all computers. Further, it would be advantageous for the locking mechanism to be removably attached to the outer cover of the computer or electronic device, so that the locking mechanism may be removed and reused with a different computer or electronic device as the device is replaced, upgraded, etc. or as security needs change.

SUMMARY OF THE INVENTION

The above and other aspects of the present invention are accomplished in a lock that may be inserted into a standardized locking aperture, such as a Kensington standard keylock slot in the cover of a computer or other electronic device to secure the cover to the chassis of the computer or device in order to prevent unauthorized access to the internal components of the computer or electronic device. The lock may be easily installed by the end user rather than having the locking mechanism installed during the manufacture of the computer with the additional cost of a locking mechanism added to all computers. Further, the locking mechanism may be removably attached to the outer cover of the computer or electronic device, such as by means of an adhesive, double sided tape, Velcro, a mechanical hook, magnet, or other known removable means, so that the locking mechanism may be removed and reused with a different computer or electronic device as the device is replaced, upgraded, etc. or as security needs change. With the present invention, an end user may purchase a computer or other electronic device and the locking mechanism of the present invention if desired and easily add a locking function to an existing electronic device as long as the device has a Kensington standardized keylock slot. Unlike a tumbler keylock, the present invention can be re-deployed to be used with a different unit quite easily when the original product is changed, obsoleted or no longer needs a keylock.

BRIEF DESCRIPTION OF THE DRAWINGS

The above and other objects, features and advantages of the present invention will be better understood by reading the following more particular description of the invention, presented in conjunction with the following drawings, wherein.

DETAILED DESCRIPTION OF THE PREFERRED EMBODIMENT

Figure 1:
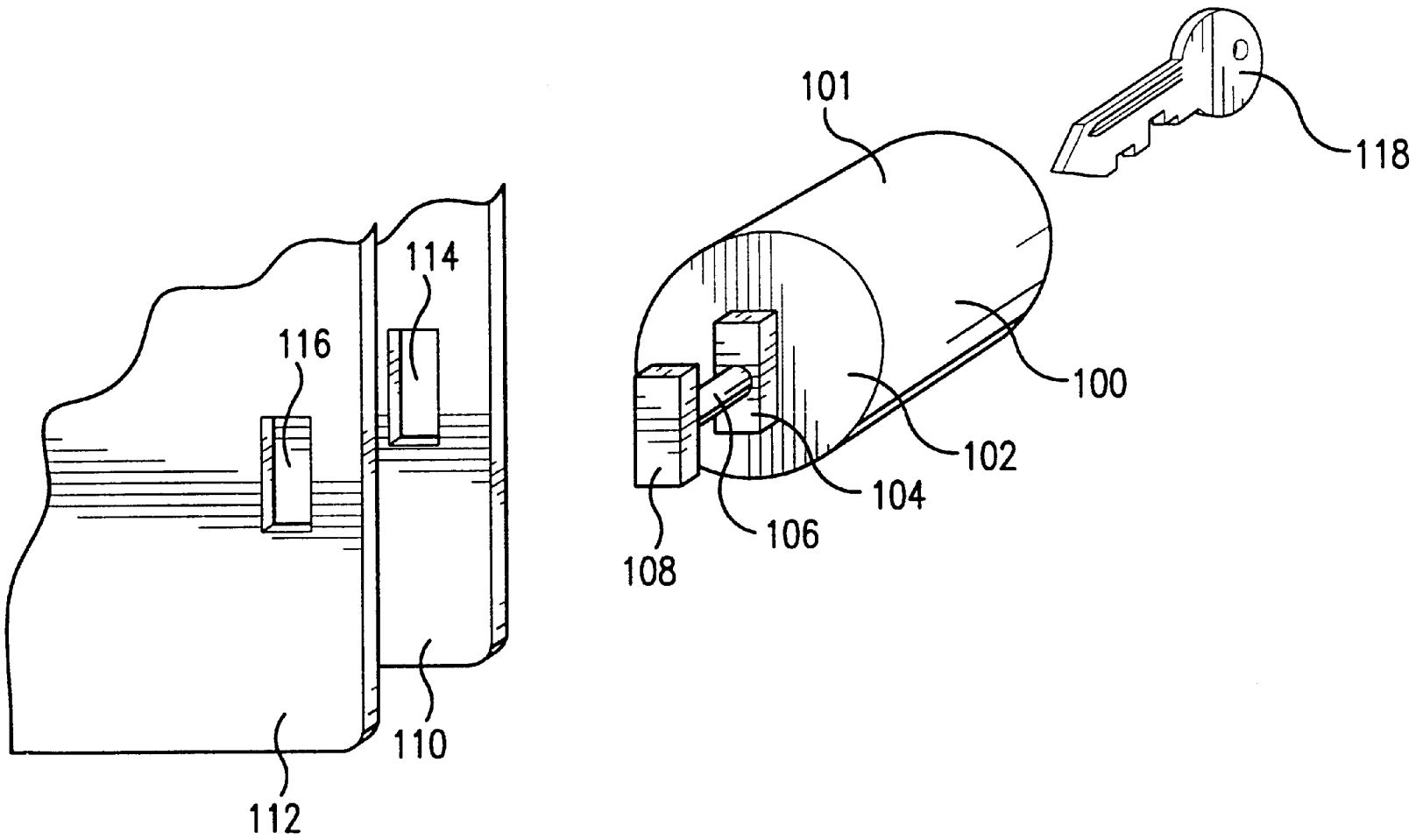
FIG. 1 illustrates a blown-up, side perspective view of the present invention in an unlocked state.
Figure 2:
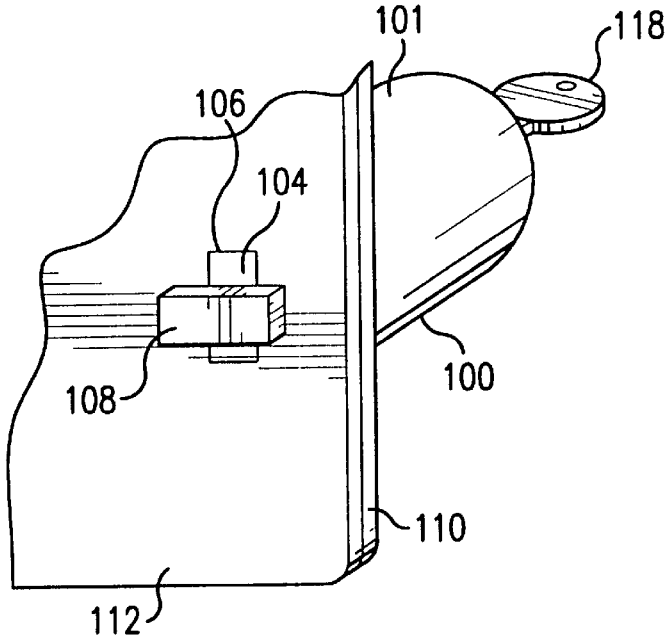
FIG. 2 illustrates a side perspective view of the present invention in a locked state.
Figure 3:
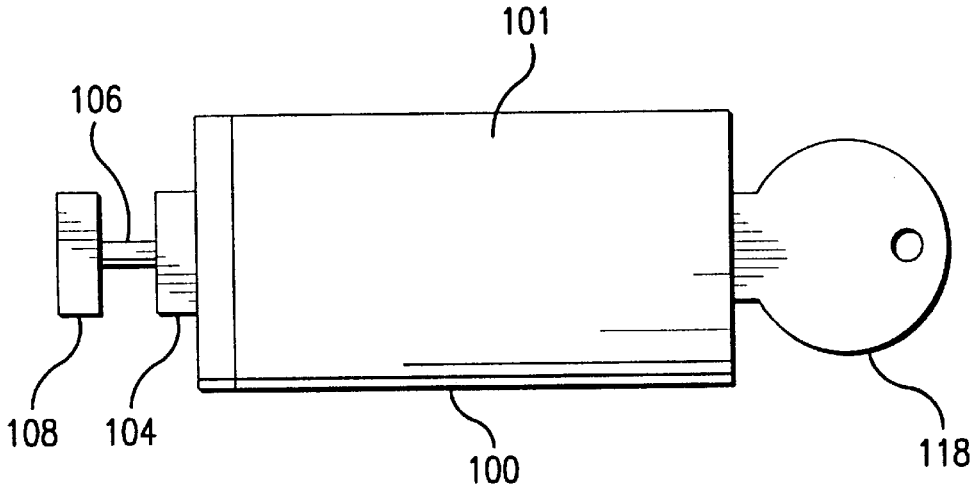
FIG. 3 illustrates a side view of the key lock in an unlocked position according to the present invention.

FIGS. 1–3 show a key lock 100 with tumbler chamber 101, rectangular locking protrusion 108 on rotating shaft 106 and corresponding key 118. In operation, rectangular locking protrusion 108 fits through slot 114 in cover 110 and slot 116 in electronic chassis 112 until anti-rotation protrusion 104 extends into slots 114 and 116 and rectangular locking protrusion 108 extends through and exits slots 114 and 116. Then key 118 is inserted into the tumbler chamber 101 and turned until rectangular locking protrusion 108 is in the locked position cross ways with respect to slots 114 and 116 in cover 110 and electronic chassis 112. Anti-rotation protrusion 104 holds the key lock 100 stationary with respect to the key lock 100 rotating within slots 114 and 116 and prevents the tumbler chamber or the key lock from being rotated with respect to slots 114 and 116. Accordingly, once the key lock 100 is in the locked position, it cannot be turned out of the locked position without turning key 118. The key 118 may then be removed from the tumbler chamber 101 as the electronic product key lock is in the locked position.

Also, face plate 102 may have an adhesive such as double sided tape or another commonly known and user self adhesive surface such that when the end used removes a protective cover from the adhesive and inserts the key lock 100 into the electronic product, the face plate 102 will adhere to the outer surface of the electronic product. Thus, when the key lock 100 is in the unlocked position, it will continue to be attached to the electronic product. However, the adhesive is a light enough adhesive product that if the end used wishes to remove the lock it is relatively easy to remove from the electronic product and install into another electronic product.

Alternatively, face plate 102 may include Velcro and a corresponding Velcro mating surface may be applied to the outer surface of the electronic product surrounding slot 114. Also, as most electronic products such as computer chassis, VCRs, and stereos have metal outer chassis covers, the face plate 102 may be a magnet sufficiently strong to allow the key lock 100 to remain attached to the electronic cover 110 when in the unlocked position, yet easily removed by the end user when the need for a key lock no longer exists, the key lock needs to be changed or removed from the electronic product.

Figure 4:
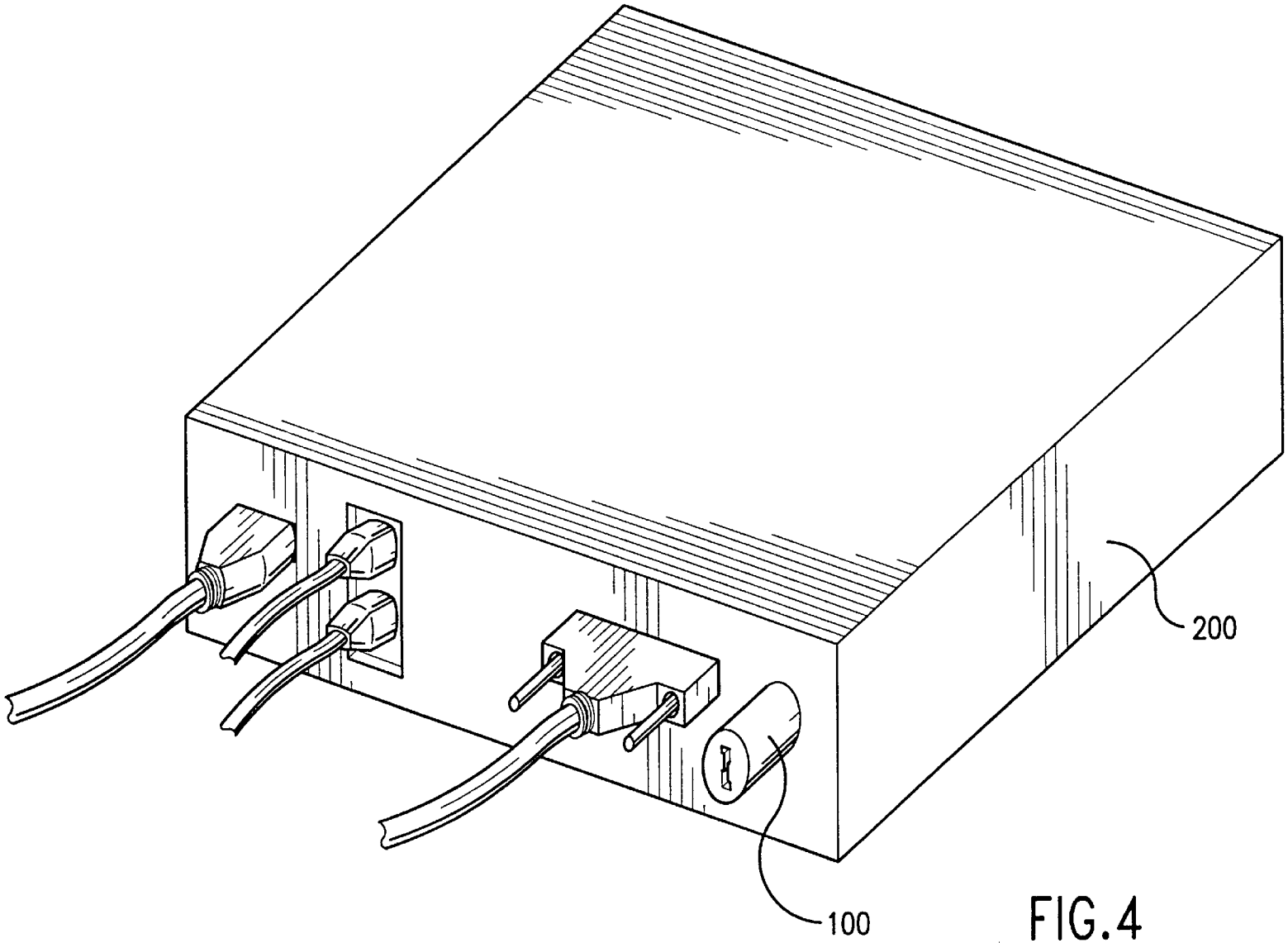
FIG. 4 illustrates a top perspective view of an electronic chassis locked with a key lock according to the present invention.
Figure 5:
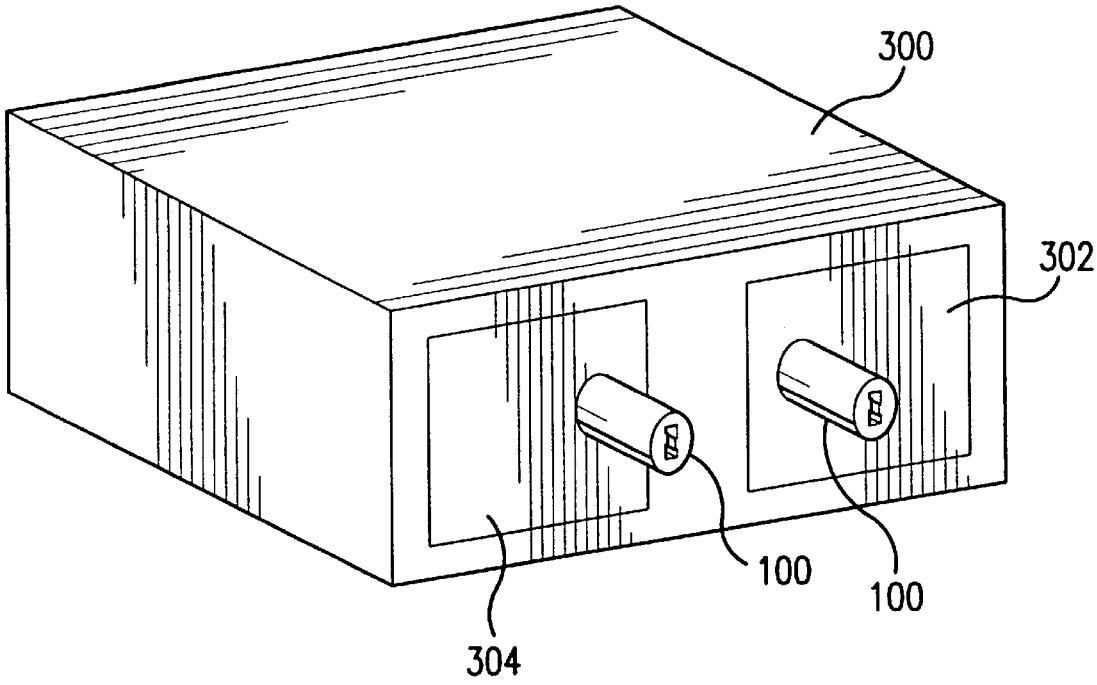
FIG. 5 illustrates a perspective view of an electronic chassis with two tape drives locked with key locks according to the present invention.

Although the key lock 100 is primarily intended to lock a cover of a computer product to the computer chassis to prevent unwanted breach of the computer cover or removal of electronic components within the computer cover (as shown in FIG. 4), it may be used to secure any outer cover to any inner chassis so long as both the outer cover 110 and the inner chassis have the appropriate slots 114 and 116 provided in the product. Also, to reduce the risk of theft, disk drives 302 and 304 may be locked within an electronic cover 300, as shown in FIG. 5. Alternatively, it may be desirable to lock-up covers to microprocessors, memories, ASICs, hard drives, data cartridges, or peripherals such as scanners, printers, copiers, facsimiles, etc.

Although slots 114 and 116, locking protrusion 108 and anti-rotation protrusion 104 may be any size or shape that permits for the insertion and locking of locking protrusion 108 and for anti-rotafion protrusion 104 to hold the tumbler chamber 101 against rotation once the key lock 100 is installed into the cover 110, it is preferable for slots 114 and 116 to be the typical Kensington slots commonly found in todays computer products. These slots are usually 5 mm by 2 mm rectangles. The rotating shaft 106 should be just long enough that the locking protrusion 108 just barely fits through slots 114 and 116 with anti-rotation protrusion 104 fitting snugly within slots 114 and/or 116. This will permit locking protrusion 108 to be rotated into the locking position, while maintaining a snug fit for the key lock 100 in relation to the electronic cover 110. The locking mechanism with the tumbler chamber may function in the manner of any known locking mechanism, so long as it causes locking protrusion 108 to twist or expand into a locked position. The tumbler chamber 101, rotating shaft 106, anti-rotation protrusion 104 and locking protrusion 108 may be made of any hard metal, such as steal, copper, aluminum, etc. or a hard plastic material.

Figure 6:
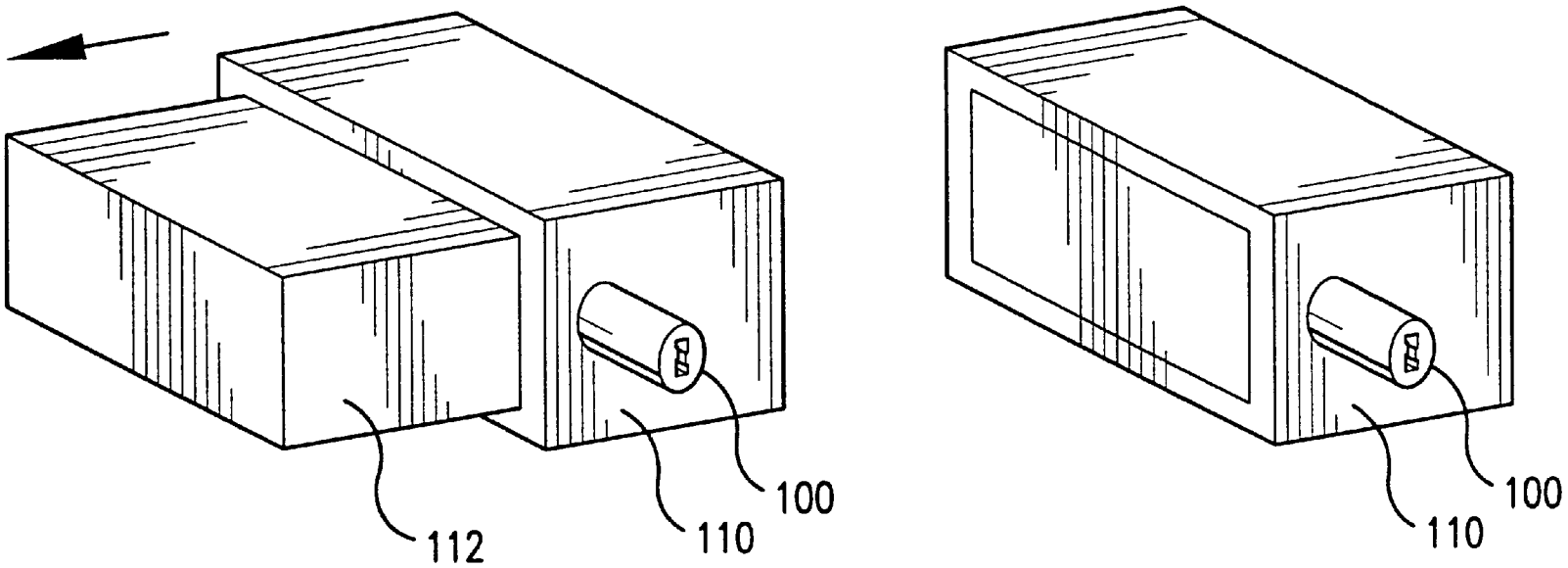
FIG. 6 illustrates a perspective view of an electronic cover the slidingly mates with a chassis with a locking means according to a second embodiment of the present invention.
Figure 7:
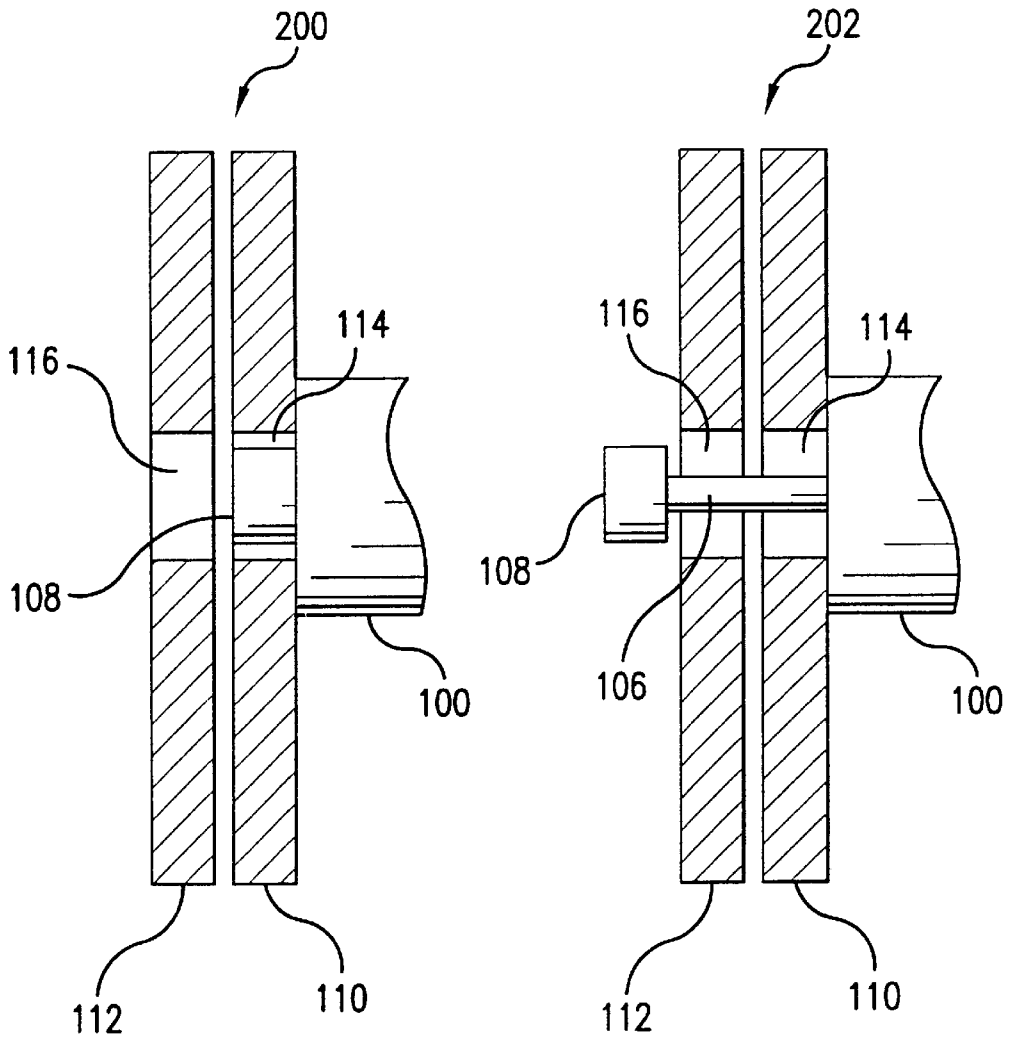
FIG. 7 illustrates a side view of a locking mechanism according to the second embodiment of the present invention.

FIGS. 6 and 7 illustrate a second embodiment of the present invention in which the electronic enclosure lock 100 may be removably attached to the outer cover 110, but the outer cover may be slidingly mated with the inner chassis 112 when the lock 100 is in the unlocked position 200. When the lock 100 is in the unlocked position, the rotating shaft 106 retracts into the tumbler chamber 101, such that locking protrusion 108 is substantially even with the inner surface 111 of outer cover 110. Accordingly, the outer cover 110 may be slidingly mated and unmated from the inner chassis 112 and the locking protrusion 108 does not interfere with the mating and unmating of the cover. When the lock 100 is in the locked position, the rotation shaft 106 extends out of the tumbler chamber 101, locking protrusion extends through the slot 116 in the inner chassis 112 and turns into the locked position.

Figure 8:
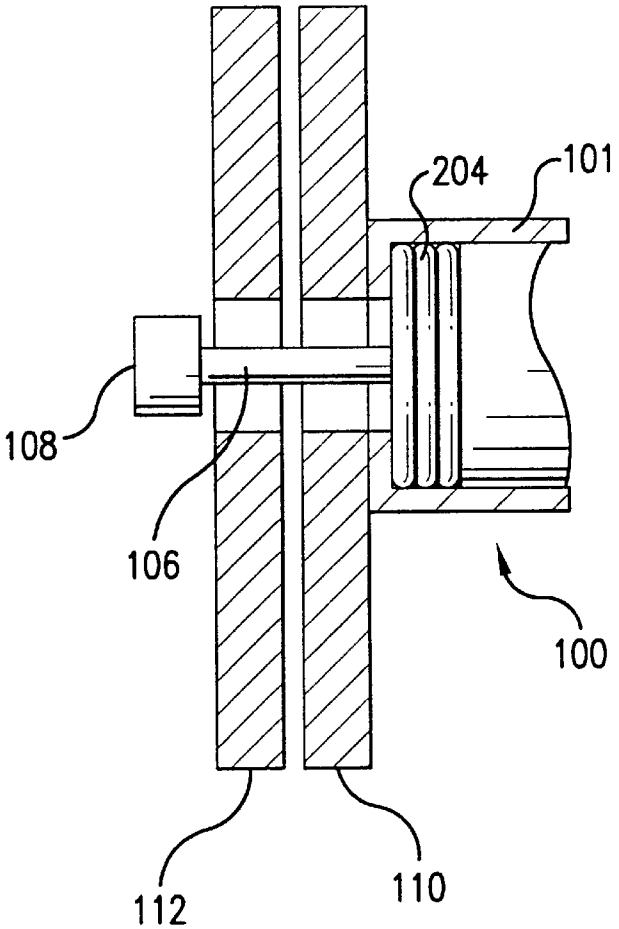
FIG. 8 illustrates a side view of a locking mechanism according to a third embodiment of the present invention.
Figure 8:
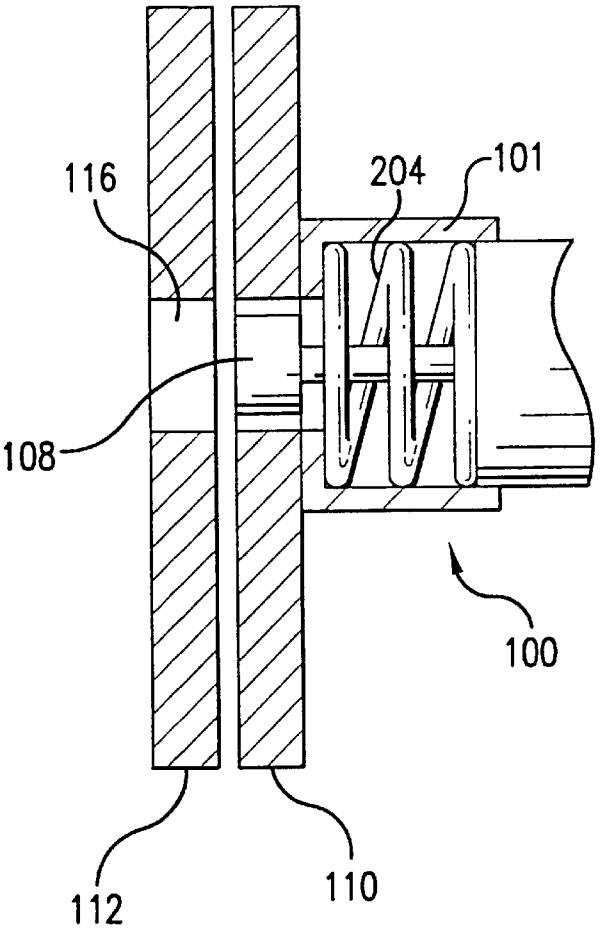

FIG. 8 illustrates a third embodiment of the present invention in which the extension and retraction of the rotating shaft 106 is accomplished by means of a spring within the tumbler chamber 101 of the lock 100. In this embodiment, the face plate 104 is attached to the outer cover 110 with the locking protrusion 108 mating with the slot 114 in the outer cover 110. To lock the cover 110 of the device, the user pushes in (towards the cover 110) while twisting the key 118. This causes the spring 204 to compress, such that the rotating shaft 106 extends out of the tumbler chamber 101 and the locking protrusion 108 to extend through the slot 116 in the inner chassis and rotate into the locked position. To unlock the cover 110, the end user turns the key 118 in the opposite direction and the compressed spring 204 expands, causing the rotating shaft 106 to retract into the tumbler chamber 101 and the locking protrusion 108 to retract back to the slot 114 of the outer cover 110. With the lock 100 in the unlocked position and the locking protrusion 108 out of the way, the cover 110 and the chassis may be slidingly mated and unmated without interference from the lock 100 and without the lock 100 having to be removed from the outer cover 110 of the electronic device.

The foregoing description of the present invention has been presented for purposes of illustration and description. It is not intended to be exhaustive or to limit the invention to the precise form disclosed, and other modifications and variations may be possible in light of the above teachings. For example, the slots 114 and 116 and locking protrusion 108 and anti-rotation protrusion 104 may be any shape or size that will accommodate a nonrotating, locking fit. Also, the key lock 100 may be attached to the electronic cover 110 by any known adhesive means. Further, the lock 100 does not need to be operated with a key, but may instead use a mechanical or software combination to lock and unlock the lock 100. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A lock for securing electronic devices within a cover having a slot with a predetermined size and shape, said lock comprising:

a tumbler chamber having a first end and a second end;

a face plate on said first end of said tumbler chamber;

an anti-rotation protrusion on said face plate of said tumbler chamber, said anti-rotation protrusion being a predetermined size and shape to correspond with said slot on said cover;

a rotating shaft having a first end and a second end, said first end of said rotating shaft extending from said face plate on said tumbler chamber;

a locking protrusion on said second end of said rotating shaft, said locking protrusion having a predetermined size and shape such that said locking protrusion may be inserted through said slot on said cover until said anti-rotation protrusion engages said slot in said cover; when said lock is inserted into said slot in said cover and in a locked position, said locking protrusion prevents said lock from being removed from said slot in said cover unless said lock is unlocked;

wherein when said lock is inserted into said slot on said cover, said anti-rotation protrusion matingly engages said slot in said cover until said face plate comes into contact with an area of said cover surrounding said slot in said cover; and wherein said face plate adheres to said area surrounding said slot in said cover.

2. The lock for securing electronic devices within a cover having a slot with a predetermined size and shape according to claim 1, wherein said face plate adheres to said area surrounding said slot in said cover by means of an adhesive, said adhesive being strong enough to keep said lock attached to said cover unless removed by an end user.

3. The lock for securing electronic devices within a cover having a slot with a predetermined size and shape according to claim 1, wherein said face plate adheres to said area surrounding said slot in said cover by means of double sided adhesive tape, said adhesive tape being strong enough to keep said lock attached to said cover unless removed by an end user.

4. The lock for securing devices within a cover having a slot with a predetermined size and shape according to claim 1, wherein said face plate is magnetic and adheres to said area surrounding said slot in said cover by means of magnetism, said magnet being strong enough to keep said lock attached to said cover unless removed by an end user.

5. The lock for securing electronic devices within a cover having a slot with a predetermined size and shape according to claim 1, wherein said slot with a predetermined size and shape is a standard Kensington keylock slot.

6. A method for locking an electronic cover having a slot with a predetermined size and shape, said method comprising the following steps:

(a) inserting a locking protrusion with a predetermined size and shape into said slot on said cover, said locking protrusion being attached to a tumbler chamber of a lock on a first end of a rotating shaft;

(b) mating an anti-rotation protrusion with said slot in said cover, said anti-rotation protrusion being on a second end of said rotating shaft, said anti-rotation protrusion having a predetermined size and shape to prevent rotation of said anti-rotation protrusion and said lock within said slot;

(c) adhering a face plate of said lock to a surface of said cover surrounding said slot; and (d) locking said lock such that said locking protrusion is lockingly mated with said slot.

7. The locking method according to claim 6, wherein said face plate is removably adhered to said surface of said cover surrounding said slot by means of an adhesive.

8. The locking method according to claim 6, wherein said locking protrusion extends into said slot when locked and retracts out of said slot when unlocked.

9. A housing for an electronic device, said housing comprising:

a chassis;

a cover member;

a first opening extending through said chassis;

a second opening extending through said cover member, wherein at least a portion of said second opening is aligned with at least a portion of said first opening;

wherein at least one of said first and second openings has a predetermined size and shape;

a lock comprising:

a face plate;

an anti-rotation protrusion on said face plate, said anti-rotation protrusion having a shape and size that correspond to said predetermined shape and size;

a rotating shaft having a locking protrusion thereon, said locking protrusion having a size and shape that correspond to said predetermined size and shape;

wherein at least a portion of said rotating shaft extends through said second opening.

10. The housing of claim 9 wherein:

both of said first and second openings have said predetermined size and shape.

11. The housing of claim 9 wherein:

said at least a portion of said rotating shaft extends through both of said first and second openings.

12. The housing of claim 9 wherein:

at least a portion of said anti-rotation protrusion extends through at least one of said first opening and said second opening.

13. The housing of claim 9 wherein:

at least a portion of said anti-rotation protrusion extends through both said first opening and said second opening.

14. The housing of claim 9 wherein:

said face plate of said lock is adhered to at least a portion of said cover.

15. The housing of claim 14 and further including:

an adhesive located between said face plate and said cover.

16. The housing of claim 14 wherein said face plate is magnetic.

17. The housing of claim 9 wherein at least one of said first and second openings is a standard Kensington keylock slot.

18. The housing of claim 9 wherein both of said first and second openings are standard Kensington keylock slots.

* * * * *